United States Patent [19]

Hauschild et al.

[11] Patent Number: 4,945,609

[45] Date of Patent: Aug. 7, 1990

[54] REVOLVING FLAT ARRANGEMENT FOR A CARDING MACHINE

[75] Inventors: Werner Hauschild, Durnten; Heinz Nitschke, Winterthur, both of Switzerland

[73] Assignee: Rieter Machine Works, Ltd., Winterthur, Switzerland

[21] Appl. No.: 416,044

[22] Filed: Oct. 2, 1989

[30] Foreign Application Priority Data

Oct. 6, 1988 [DE] Fed. Rep. of Germany ..... 3834040

[51] Int. Cl.[5] ..... D01G 15/78

[52] U.S. Cl. ..... 19/102; 19/109; 19/111

[58] Field of Search ..... 19/102, 103, 104, 105, 19/109, 110

[56] References Cited

U.S. PATENT DOCUMENTS

| | | | |
|---|---|---|---|
| 2,683,901 | 7/1954 | Griswold | 19/109 |
| 3,995,351 | 12/1976 | Otani | 19/102 |
| 4,079,483 | 3/1978 | Hicks | 19/107 |
| 4,126,915 | 11/1978 | Zieg et al. | 19/109 |
| 4,129,924 | 12/1978 | Wirth | 19/109 |
| 4,196,497 | 4/1980 | Beneke et al. | 19/110 |
| 4,353,149 | 10/1982 | Demuth et al. | 19/110 |
| 4,805,267 | 2/1989 | Leifeld | 19/105 |

FOREIGN PATENT DOCUMENTS

| | | | |
|---|---|---|---|
| 1919934 | 5/1963 | Fed. Rep. of Germany . | |
| 1292551 | 4/1969 | Fed. Rep. of Germany . | |
| 2313727 | 9/1973 | Fed. Rep. of Germany . | |
| 2950367 | 6/1981 | Fed. Rep. of Germany . | |
| 0635567 | 3/1928 | France . | |
| 1432282 | 2/1966 | France . | |
| 2259167 | 8/1975 | France . | |
| 180178 | 5/1922 | United Kingdom | 19/109 |
| 1038426 | 8/1966 | United Kingdom . | |

*Primary Examiner*—Werner H. Schroeder
*Assistant Examiner*—John J. Calvert
*Attorney, Agent, or Firm*—Kenyon & Kenyon

[57] ABSTRACT

A revolving flat arrangement for a carding machine is characterized in that a suction tube with a suction opening is arranged within the loop at the deflection position from the card cylinder to the cleaning device and/or at the deflection position before the card cylinder. Fibers and particles of contamination which are carried by the flats and which reach the interior of the loop are sucked out through the suction tube.

20 Claims, 3 Drawing Sheets

REVOLVING FLAT ARRANGEMENT FOR A CARDING MACHINE

This invention relates to a revolving flat arrangement for a carding machine.

As is known, revolving flat arrangements generally have revolving flats which, during operation, circulate continuously in a closed loop and, after passing a needle clothing of a card cylinder, are turned around and moved past a cleaning device, after which they are again turned around and resume interworking with the card cylinder. Such revolving flat arrangements are frequently found in modern carding machines. The cleaning device serves to separate the waste products (strips) of the carding machine from the revolving flats, such waste products arising through the carding operation and consisting of fibers and also particles of contamination.

The revolving flats themselves are normally secured at their two ends to chains which are driven in a synchronized manner via gear wheels from a common shaft in order to produce the circulatory movement of the revolving flats in the closed loop. The chains are guided during this recirculatory movement by corresponding guides.

Despite the presence of the cleaning device, dust and fibers collect within the closed loop and combine at the deflection positions, principally at the deflection position in front of the cleaning device, into a sausage-like "flying roll", which can become fairly large and thick. In extreme cases, damage to the carding machine can also occur. Moreover, the undesired danger also exists that fibers or contamination which has once entered into the loop, will emerge again from the loop, and will be carried by the revolving flats into the region between the revolving flats and the carding cylinder. Fibers and contamination are totally undesired at this location, particularly since they have been twisted together during their time within the loop into a relatively firm structure and can also be contaminated with lubricant. They, thus, not only make the carding operation more difficult but can also lead to undesired contamination of the carded fleece and, thus, of the card sliver and can disadvantageously affect the subsequent yarn manufacturing process.

Accordingly, it is an object of the invention to effectively counteract the collection of dust and fibers within a revolving flat arrangement.

It is another object of the invention to provide a simplified arrangement for removing unwanted particles from within a revolving flat arrangement.

It is another object of the invention to remove dust and contamination particles from a revolving flat arrangement in a simple manner.

Briefly, the invention provides a revolving flat arrangement for a carding machine which is comprised of an endless loop of flats for disposition over a carding cylinder and a suction device within the loop having a suction opening extending across the opening extending across the width of the flats to draw a flow of air thereinto and an outlet opening at one end for exhaust of the drawn-in air. In addition, a cleaning device is disposed over the loop of flats near at least one end of the loop.

The suction device is arranged within the loop at the deflection position from the card cylinder to the cleaning device and/or at the deflecting position before the card cylinder. The suction device operates so that fibers and particles of contamination which are carried by the flats and which reach the interior of the loop are sucked out there.

The suction device is, in particular, in the form of a suction tube which extends at least substantially over the full width of the card, i.e. over the length of the revolving flats, and which has a suction slot forming a suction opening which likewise extends over the length of the revolving flats. The tube also has an outlet opening at one end for connection with a suction source. These are simple constructional features which solve the underlying object in an elegant manner and which can be realized with stationary parts.

The wall parts of the suction tube forming the suction slot preferably form a supply channel in the region of the suction slot which opens tangentially into the suction tube, which has at least a substantially circular cross-section. In this way, the flow entering through the suction slot is guided tangentially into the suction tube. This tangential flow in combination with the simultaneous application of suction to the suction tube generates a kind of helical flow within the suction tube which, on the one hand, keeps the walls of the tube clean and, on the other hand, always keeps the particles of contamination which are moved along with the flow in motion and always transports them away in the direction of the suction source along this tube. Thus, particles of contamination cannot be caught up in the suction tube, which has smooth internal surface, and cannot collect there, so that service-free operation is possible over a very long period of time.

The revolving flat arrangement is preferably so contrived that the revolving flats move along an at least substantially partly circular track at the deflection position, due to the use of corresponding guides, with the center of curvature of this partly circular track coinciding with the central longitudinal axis of the suction tube. In this way, the suction tube can be accommodated in a space-saving manner and indeed at a position at which the suction opening can directly suck away the dust which falls from the revolving flats.

Furthermore, this position of the suction tube is a precondition for a special revolving flat arrangement which is characterized in that the outer wall region of the suction tube facing towards the rear sides of the revolving flats, which have the longitudinal ribs, is covered with a resilient cushion material, and in that the end edges of the ribs which are disposed within the loop sweep over this cushion material during the recirculating movement. In this way, the "upholstered" wall region of the suction tube forms a type of conveyor device with the ribs of the revolving flats, whereby the particles of contamination which pass via gravity to the lower parts of the loop are again transported upwardly around the wall region of the suction tube, until they reach a position at which they are picked up by the tangential flow and transported into the suction tube.

It is also possible to achieve the same effect by mounting resilient sealing lips on the revolving flats, with the resilient sealing lips sweeping during the recirculating movement of the revolving flats along the outer wall region of the suction tube facing the revolving flats. It is also entirely possible to simultaneously use the sealing lips and the cushion material. The sealing lips or the sealing action between the ribs and the cushion material leads not only to a favorable transport of the contamination to be removed, but also restricts the possibilities of leakage air flowing to the suction opening so that, on the one hand, a very intensive suction action arises at the suction opening and, on the other hand, the air consumption can be kept within limits.

The suction slot is preferably arranged at an angular position which, on mounting the suction tube at the deflection position in front of the cleaning device, and considered in the direction towards the right hand end face of the card, lies approximately between the 9 o'clock and the 11 o'clock positions which corresponds to 270°-330°.

In this position of the suction tube, not only is the sucked in contamination effectively removed but also there is no danger, on switching off the suction source, that any particles of contamination which eventually remain in the suction tube can again drop out the suction tube.

A particularly preferred embodiment is characterized in that a panel-like guide part projects upwardly from the upper longitudinal edge of the suction slot and extends at least substantially parallel to the local path of movement of the revolving flats.

When the particles of contamination or fibers carried by the revolving flats drop downwardly from the revolving flats after passing the suction opening then these particles or fibers are transported further upwardly by the ribs of the revolving flats and the panel-like guide part. When the ribs of the revolving flats reach the upper edge of the panel-like guide part, the fibers and particles then drop under gravity and are picked up again by the lower revolving flats, which are just leaving the carding cylinder, and are again transported into the region of the suction slot.

The suction tube is preferably composed essentially of two sheet metal parts. A first part forms the panel-like guide part and a part of the wall of the suction tube with the guide part and the wall part merging into one another at a hairpin-like region. The second part forms the remainder of the wall of the suction tube and merges at the lower edge of the suction slot into a web which projects into the interior of the suction tube and forms the supply channel. A construction of this kind can be manufactured at favorable cost.

The web at the lower edge of the suction slot which projects into the interior of the suction tube and forms the supply channel is preferably pivotally connected to the lower edge of the suction slot. In this way, one achieves both the possibility of a certain adjustment of the ideal suction action and also the possibility of completely closing the suction opening through a corresponding pivotal movement of the web. In one variant, the web is mounted on a carrier part which is displaceable on a wall region adjacent the lower edge of the suction slot. In this way, the size of the suction opening can also be changed and, if necessary, be closed.

It is in any event preferable if a means is provided for closing the suction opening, since the suction means does not need to be permanently in operation, because of the relatively small quantities of the fibers and contamination which penetrate into the loop in a specific period of time.

These and other objects and advantages of the invention will become more apparent from the following detailed description taken in conjunction with the accompanying drawings wherein:

FIG. 1 schematically illustrates a side view of a carding machine constructed in accordance with the invention;

FIG. 2 illustrates an enlarged representation of the region II of FIG. 1 which includes a deflection position for the revolving flats of the carding machine;

FIG. 3 schematically illustrates a suction tube employed in the revolving flat arrangement of FIG. 2 in accordance with the invention;

Figure 1:
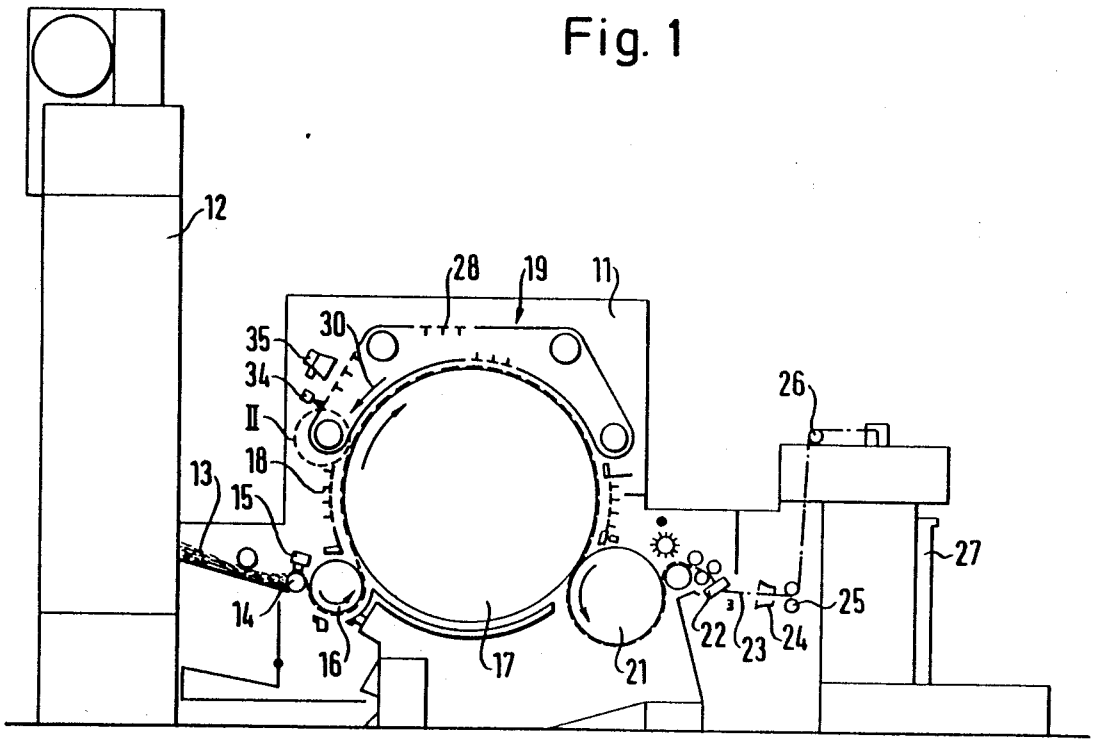

Referring to FIG. 1, the carding machine includes a card 11 to which flocks are delivered from a flock feeder 12 in the form of a lap or wad 13 via a feed roller 14 and a trough plate 15 as is known. In addition, a licker-in roll 16 is provided downstream of the plate 15 to pick up the flocks in the form of separated cotton fibers from the wad 13 for delivery to a main cylinder 17 of the card 11. As indicated, a plurality of stationary flats 18 are provided downstream of the passage between the roll 16 and cylinder 17 and extends to a region of a revolving flat arrangement 19.

After the revolving flat arrangement 19, the carded out cotton fibers are picked by a take-off roll 21 and are combined by a transverse conveyor 22 into a fiber sliver 23 which is subsequently deposited into a can 27 via a funnel 24, measurement roller 25 and a deflection roller 26.

Figure 2:
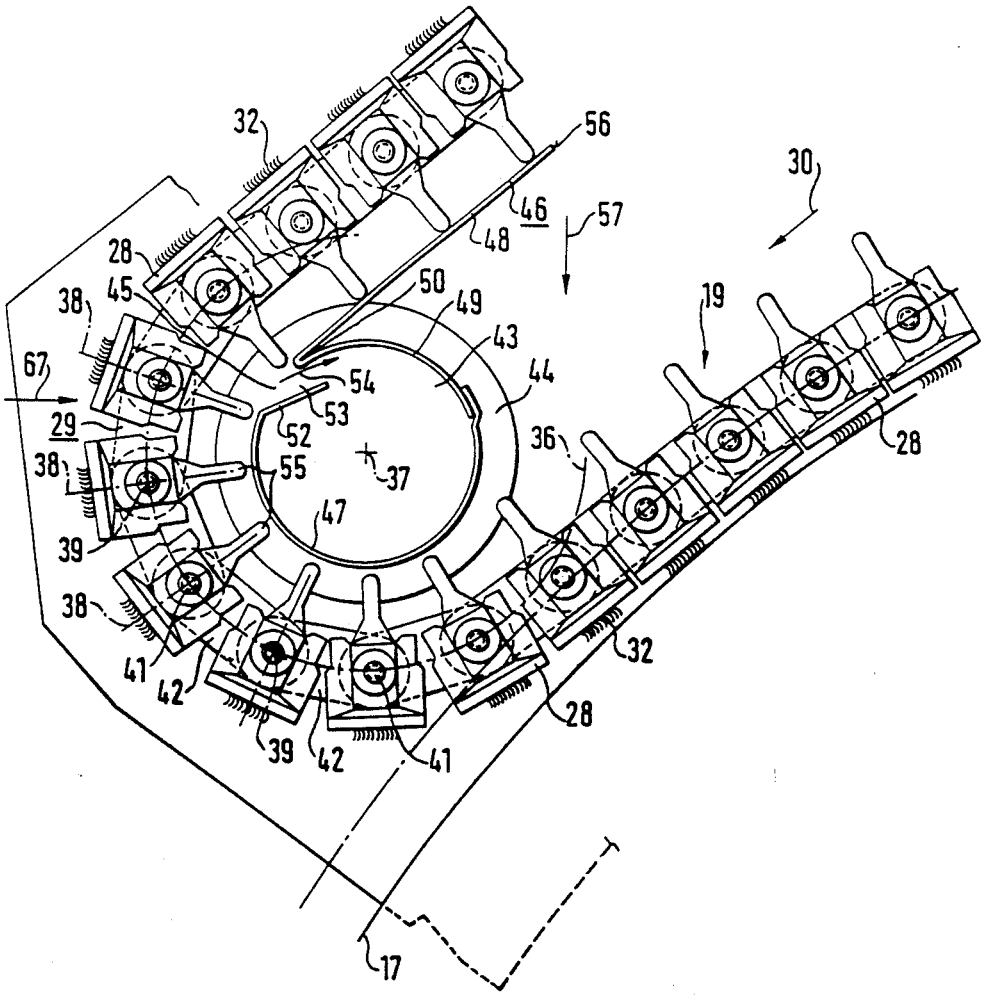

Referring to FIG. 2, the revolving flat arrangement 19 consists of an endless loop of individual flats 28 which are carried at their ends by respective chains 29 and which circulate in accordance with the direction indicated by the arrow 30. Each flat 28 carries a needle clothing of fine wires 32 which, in the lower run of the recirculating chains, point downwardly in the direction of the main cylinder 17 which carries a similar needle clothing which points outwardly and upwardly. As a result of the carding action which takes place between the revolving flats 28 and the main cylinder 17 some fibers are picked up by the needle clothing of the revolving flats 28 together with contamination. These collections of fibers on the revolving flats 28 form so-called strips which must be removed from the revolving flats. Each flat 28 also has a rib 55 projecting into the interior of the arrangement 19.

Each chain 29 is formed of individual chain links 42 which are hingedly connected to hinge pins 41 on the ends of the respective flats 28.

Referring to FIG. 1, a cleaning device is disposed over the flat arrangement 19 to clean the flats 28 of fiber and contamination particles. This cleaning device includes a comb 34 and a suction device 35. The comb 34 extends over the full length of the revolving flats, i.e. substantially over the full width of the carding machine which is perpendicular to the plane of FIG. 1, and functions to comb fibers from the clothing in each flat for delivery to the suction device 35.

As shown in FIG. 2, the chains 29 and, thus, also the flats 28 which are carried by the latter are so guided at the lower deflection position that they move along a partly circular path 36 having a center of curvature 37 which lies within the revolving flats 28. During this movement, the individual flats 28 are so guided that they always stand perpendicular to the curved path 36 which is schematically illustrated by the chain dotted lines 38. The precise construction of the guide track is adequately known in the prior art and does not need to be discussed here in detail. It is, however, clear that the individual flats 28 are so mounted that their longitudinal pivot axes are coaxial to the hinge pins 41 between the individual chain links 42.

A suction device in the form of an elongate suction tube 43, which extends over the full width of the card, is located at the deflection position coaxial to the center of curvature 37 of the path 36 of the flats 28 and terminates at one side face of the card, namely at the side face which lies beneath the plane of the drawing of FIG. 1, at a flange 44. This flange 44 permits the connection of the suction tube 43 to a suction source (not illustrated). The other end of the suction tube 43 is preferably closed. A suction slot 45 which forms a suction opening extends over the full length of the suction tube 43. The suction tube 43 is formed essentially of two sheet metal parts 46, 47. One part 46 forms both a flat panel-like guide part 48 and also a curvilinear part 49 of the wall of the suction tube 43. The two parts 48, 49 merge into one another via a region 50 which is curved in hairpin-like manner. The second part 47 of the suction tube 43 forms a remainder of the wall of the suction slot 45 and merges at the lower edge of the suction slot 45 into a web 52 which projects into the interior of the suction tube 43 to form a supply channel 53 which opens tangentially into the suction tube 43.

On taking the suction source into operation, a tangential air flow (arrow 54) thus arises through the suction slot 45 into the interior of the suction tube 43 and, in total, a flow arises which moves helically around the central longitudinal axis 37 of the suction tube 43. Any particles of contamination, dust or fibers which fall down from the revolving flats or from longitudinal ribs of the revolving flats 28 are picked up by this air flow 54 and transported into the suction tube. They remain suspended in the moving air mass as a result of the helical flow and do not drop out. They are thus effectively removed from the interior of the suction tube 43. Should further particles of contamination, dust or fibers drip from the revolved flats 28 after passing the suction slot 53, for example because they are loosened by the action of the comb 34 then they will drop downwardly again after the upper edge 56 of the panel-like guide part 48, which is illustrated by the arrow 57. These particles are picked up again by the lower revolving flats and transported upwardly with the latter into the region of the suction slot 45.

Figure 3:
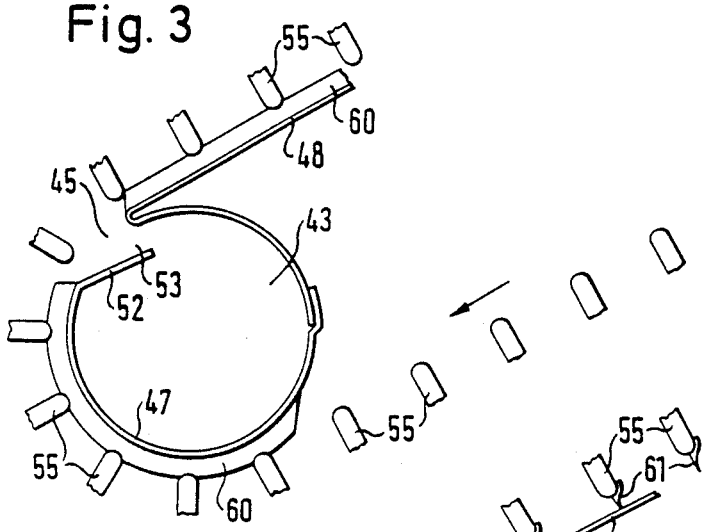

Referring to FIG. 3, the outer region of the suction tube 43 facing the revolving flats can be covered with a layer of resilient cushion material 60 into which the rounded longitudinal edges of the ribs 55 press to a small degree. In this way, an effective transport is achieved of the particles of contamination or fibers to the suction opening 45. At the same time, the cushion material seals against the longitudinal ribs 55 of the revolving flats so that not too much leakage air is sucked into the supply channel 53.

Figure 4:
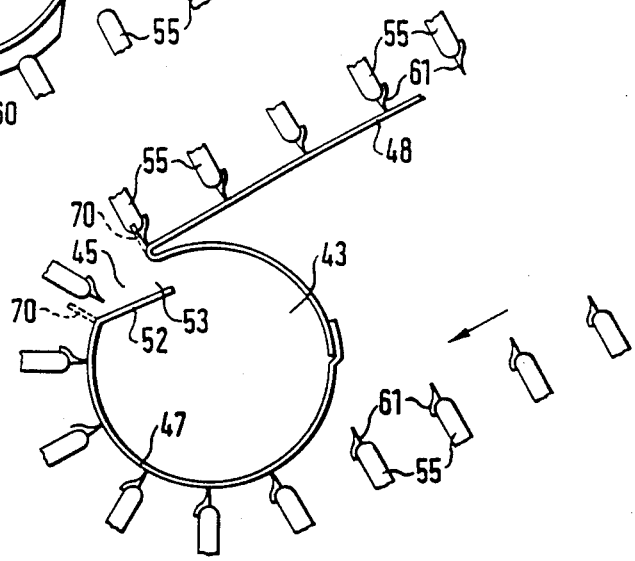
FIG. 4 illustrates a view of a modified suction tube in accordance with the invention.

FIG. 4 shows a similar arrangement in which, however, flexible sealing lips 61, for example of neoprene, are secured to the leading edges of the ribs 55 of the revolving flats and sweep along the outer wall of the suction tube 43. In place of the sealing lip 61, one sealing lip 70 (shown in broken lines) could also be provided on both sides of the suction opening 45 and secured to the suction tube 43.

Figure 5:
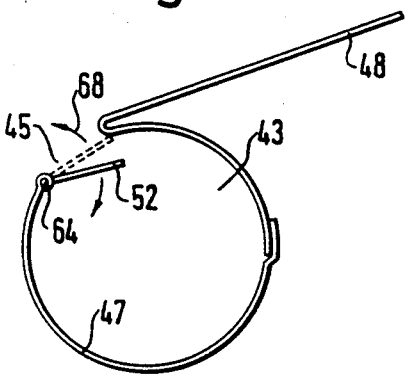
FIG. 5 illustrates an end view of a further modified suction tube in accordance with the invention.
Figure 6:
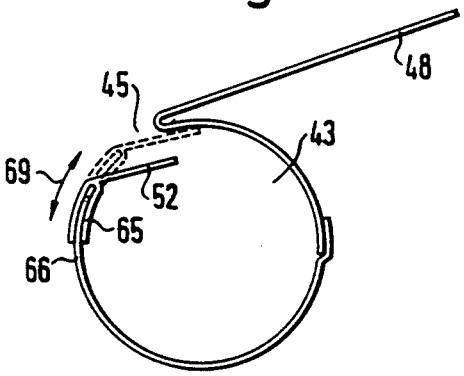
FIG. 6 illustrates an end view of a further modified suction tube in accordance with the invention.

FIG. 5 shows a modified embodiment of the suction tube 43 in which the web 52 is secured by means of a hinge 64 to the lower edge of the suction slot 45 over the full length of this slot, for example, via a piano hinge. In this way, an adjustment of the web 52 is possible (double arrow 68) which makes it possible to adapt the arrangement to the ideal suction configuration and also in the position shown in broken lines, makes full closing of the suction opening possible. A further possibility of closing the opening is illustrated in FIG. 6. Here the web 52 is secured to a bifurcated curved part 65 which is displaceably mounted (double arrow 69) on a wall region 66 of the suction tube. In this embodiment, both restriction and full closing of the suction opening 45 is possible.

Finally, the suction slot 43 can have the shape of an elongate triangle, as seen in plan view, for example in accordance with the arrow 67 of FIG. 2, with the narrowest position of the slot being located in the region of the flange 44 so that the suction effect is uniformly distributed over the full length of the suction tube.

What is claimed is:

1. A revolving flat arrangement for a carding machine comprising an endless loop of flats for disposition over a carding cylinder; and a suction tube within and extending across the width of said loop at one end of said loop, said suction tube having a slot extending across the width of said flats to define a supply channel directed tangentially of said tube for drawing a flow of air thereinto and an outlet opening at one end for exhaust of the drawn-in air.

2. A revolving flat arrangement as set forth in claim 1 wherein said flats are movable about a part circular track having a center of curvature coincident with a center of curvature of said suction tube.

3. A revolving flat arrangement as set forth in claim 2 which further includes a flat panel-like guide part extending from a downstream side of said tube in facing relation to said flats and layer of resilient cushion material on said guide part for sliding engagement with inwardly projecting ribs of said flats.

4. A revolving flat arrangement as set forth in claim 3 which comprises a layer of resilient cushion material on said tube upstream of said slot.

5. A revolving flat arrangement as set forth in claim 1 wherein each flat has a resilient sealing lip disposed on an inwardly directed rib thereof for slidingly engaging with said suction tube during passage thereby.

6. A revolving flat arrangement as set forth in claim 1 wherein said slot is disposed in a cross-section of said suction tube corresponding to an angular position from 270° to 330°.

7. A revolving flat arrangement as set forth in claim 1 which further includes a flat panel-like guide part extending from a downstream side of said tube in facing relation to said flats.

8. A revolving flat arrangement as set forth in claim 1 wherein said suction tube is a two-part tube, one of said parts forming a flat guide part extending in facing relation to said flats and a curvilinear part of said tube, said guide part and said curvilinear part defining a hairpin region therebetween, said other of said parts of said tube merging at a lower edge of said slot into a web projecting into the interior of said tube to form a supply channel.

9. A revolving flat arrangement as set forth in claim 1 which further comprises a web extending inwardly of said slot of said suction tube to bound a supply channel thereat.

10. A revolving flat arrangement as set forth in claim 9 wherein said web is pivotally connected to said tube at a lower edge of said opening.

11. A revolving flat arrangement as set forth in claim 9 which further comprises a bifurcated carrier slidably mounted on said tube at a lower edge of said opening, said carrier having said web mounted thereon for movement therewith to vary the size of said opening.

12. A revolving flat arrangement as set forth in claim 1 which further comprises means for opening and closing said opening.

13. In a card, the combination comprising a rotatable carding cylinder;

an endless loop of flats disposed over said carding cylinder for carding of fiber therebetween;

a cleaning device disposed over said loop near at least one end thereof; and a suction tube within said loop upstream of said cleaning device, said tube having a tangentially directed suction opening extending across the width of said flats to draw a flow of air thereinto and an outlet opening at one end for exhaust of the drawn-in air.

14. The combination as set forth in claim 13 wherein said flats are movable about a curved path having a center of curvature coincident with a center of curvature of said tube.

15. The combination as set forth in claim 13 which further includes a flat panel-like guide part extending from a downstream side of said tube in facing relation to said flats.

16. The combination as set forth in claim 15 which further includes a layer of resilient cushion material on said guide part for sliding engagement with inwardly projecting ribs of said flats.

17. The combination as set forth in claim 18 which further comprises means for opening and closing said opening.

18. A revolving flat arrangement for a carding machine comprising an endless loop of flats for disposition over a carding cylinder, said flats being movable about a part circular track having a center of curvature coincident with a center of curvature of said suction tube, with each flat having an inwardly projecting rib; and a suction device within and at one end of said loop, said suction device having a suction opening extending across the width of said flats to draw a flow of air thereinto, an outlet opening at one end for exhaust of the drawn-in air, and a flat panel-like guide part extending from a downstream side in facing relation to said ribs of said flats.

19. An arrangement as set forth in claim 18 further comprising a layer of resilient cushion material on said guide part for sliding engagement with said inwardly projecting ribs of said flats.

20. A revolving flat arrangement as set forth in claim 18 wherein each flat has a resilient sealing lip disposed on an inwardly directed rib thereof for slidingly engaging with said guide part during passage thereby.

* * * * *